US007211943B2

(12) United States Patent
Watanabe et al.

(10) Patent No.: US 7,211,943 B2
(45) **Date of Patent: *May 1, 2007**

(54) ELECTRON SOURCE PLATE, IMAGE-FORMING APPARATUS USING THE SAME, AND FABRICATING METHOD THEREOF

(75) Inventors: Yasuyuki Watanabe, Tokyo (JP); Kazuya Ishiwata, Kanagawa (JP); Shinsaku Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/118,419

(22) Filed: May 2, 2005

(65) Prior Publication Data

US 2005/0189867 A1 Sep. 1, 2005

Related U.S. Application Data

(62) Division of application No. 10/347,929, filed on Jan. 22, 2003, now Pat. No. 6,903,504.

(30) Foreign Application Priority Data

Jan. 29, 2002 (JP) ..... 2002/019421

(51) Int. Cl.
*H01J 1/304* (2006.01)

(52) U.S. Cl. ..... 313/495; 313/496

(58) Field of Classification Search ..... 313/495, 313/496

See application file for complete search history.

(56) References Cited

U.S. PATENT DOCUMENTS 4,940,916 A 7/1990 Borel et al.
5,455,597 A 10/1995 Nakamura et al. ..... 345/75
5,659,329 A 8/1997 Yamanobe et al. ..... 345/74
5,818,403 A 10/1998 Nakamura et al. ..... 345/74
5,831,387 A 11/1998 Kancko et al. ..... 313/495
6,087,770 A 7/2000 Kancko et al. ..... 313/495
6,137,218 A 10/2000 Kaneko et al. ..... 313/495
6,137,298 A 10/2000 Binns ..... 324/755
6,169,356 B1 1/2001 Ohnishi et al. ..... 313/495
6,179,678 B1 1/2001 Kishi et al. ..... 445/24
6,246,168 B1 6/2001 Kishi et al. ..... 313/495
6,296,896 B1 10/2001 Takahashi et al. ..... 427/77
6,344,711 B1 2/2002 Ohnishi et al. ..... 313/495

(Continued)

FOREIGN PATENT DOCUMENTS

EP 0 660 357 A1 6/1995

(Continued)

*Primary Examiner*—Nimeshkumar D. Patel
*Assistant Examiner*—Matt Hodges
(74) *Attorney, Agent, or Firm*—Fitzpatrick, Cella, Harper & Scinto

(57) ABSTRACT

A covering layer for insulating between column wirings and device electrodes is formed in a region including each cross point of the column wirings and row wirings and under the column wirings. Thus, when an electron source plate in which a large number of electron-emitting devices are wired in passive matrix is formed, a defect resulting from an interaction between the device electrodes and the column wirings at the time of wiring formation is reduced to improve insulation reliability. Therefore, a high quality image is obtained by a large size and higher density pixel arrangement in an image-forming apparatus using the electron source plate.

2 Claims, 14 Drawing Sheets

U.S. PATENT DOCUMENTS

| | | | | |
|---|---|---|---|---|
| 6,384,541 | B1 | 5/2002 | Ohnishi et al. | 315/169.3 |
| 6,538,391 | B1 | 3/2003 | Suzuki et al. | 315/169.2 |
| 6,653,232 | B2 | 11/2003 | Uda et al. | 438/669 |
| 6,853,117 | B2 | 2/2005 | Toshima et al. | 313/304 |
| 6,866,989 | B2 | 3/2005 | Watanabe et al. | 430/394 |
| 6,903,504 | B2 * | 6/2005 | Watanabe et al. | 313/495 |
| 2002/0003398 | A1 | 1/2002 | Meguro et al. | 313/495 |
| 2002/0008454 | A1 | 1/2002 | Ishiwata et al. | 313/310 |
| 2002/0070677 | A1 | 6/2002 | Yamada et al. | 315/169.4 |
| 2002/0095785 | A1 | 7/2002 | Kubo et al. | 29/846 |
| 2003/0027417 | A1 | 2/2003 | Uda et al. | 438/618 |
| 2003/0030357 | A1 | 2/2003 | Toshima et al. | 313/310 |
| 2003/0049572 | A1 | 3/2003 | Watanabe et al. | 430/394 |
| 2003/0060114 | A1 | 3/2003 | Yanagisawa et al. | 445/24 |

FOREIGN PATENT DOCUMENTS

| | | | |
|---|---|---|---|
| EP | 0 736 892 | A1 | 10/1996 |
| EP | 0 936 652 | A1 | 8/1999 |
| EP | 0 604 975 | | 10/2000 |
| JP | 64-031332 | | 2/1989 |
| JP | 1-313332 | | 12/1989 |
| JP | 6-342636 | | 12/1994 |
| JP | 7-235255 | | 9/1995 |
| JP | 07/326311 | | 12/1995 |
| JP | 8-185818 | | 7/1996 |
| JP | 09-017359 | | 1/1997 |
| JP | 09-050757 | | 2/1997 |
| JP | 9-102271 | | 4/1997 |
| JP | 2903295 | | 3/1999 |
| JP | 2000-251665 | | 9/2000 |
| JP | 2001-189125 | | 7/2001 |
| JP | 2001-312957 | | 11/2001 |

* cited by examiner

ELECTRON SOURCE PLATE, IMAGE-FORMING APPARATUS USING THE SAME, AND FABRICATING METHOD THEREOF

This application is a division of U.S. application Ser. No. 10/347,929, filed Jan. 22, 2003 now U.S. Pat. No. 6,903,504.

BACKGROUND OF THE INVENTION

1. Field of the Invention

The present invention relates to an electron source plate in which a plurality of electron-emitting devices are arranged in matrix and an image-forming apparatus such as a display apparatus using the electron source plate.

2. Related Background Art

Up to now, there have been known two types of electron-emitting devices, a thermionic source and a cold cathode electron source. The cold cathode electron source includes a field emission device (FE device), a metal/insulating-layer/metal device (MIM device), a surface conduction electron-emitting device, and the like.

The present applicant has made a large number of proposals related to electron-emitting devices and its applications up to now and describes a part of them.

Device formation using an inkjet method is described in detail in Japanese Patent Application Laid-open No. 09-102271 (U.S. Pat. No. 6,296,896 A1) and Japanese Patent Application Laid-open No. 2000-251665 (EP 936652 A1). An example in which these devices are arranged in an XY-matrix shape is described in detail in Japanese Patent Application Laid-open No. 64-031332 and Japanese Patent Application Laid-open No. 07-326311. Further, a wiring forming method is described in detail in Japanese Patent Application Laid-open No. 08-185818 (U.S. Pat. No. 5,831,387 A, U.S. Pat. No. 6,087,770 A, and U.S. Pat. No. 6,137,298 A) and Japanese Patent Application Laid-open No. 09-050757. A driving method is described in detail in Japanese Patent Application Laid-open No. 06-342636 (U.S. Pat. No. 5,455,597 A, U.S. Pat. No. 5,659,329 A, and U.S. Pat. No. 5,818,403 A) and the like.

Also, a structure of a surface conduction electron-emitting device, its fabricating method, and the like are described in detail in, for example,. Japanese Patent Application Laid-open No. 07-235255 (U.S. Pat. No. 6,169,356 B, U.S. Pat. No. 6,344,711 B, and U.S. Pat. No. 6,384,541 B) and Japanese Patent Application Laid-open No. 2903295 (U.S. Pat. No. 6,179,678 B and U.S. Pat. No. 6,246,168 B).

Hereinafter, a summary of the surface conduction electron-emitting device disclosed in the above publications will be briefly described.

As schematically shown in FIG. 13A or 13B, the above surface conduction electron-emitting device includes a pair of device electrodes 2 and 3 on a substrate 1 which are opposed to each other and an electroconductive film 4 which is connected to the device electrodes and has partially an electron-emitting region 5.

The above surface conduction electron-emitting device has a simple structure is fabricated easily and thus has an advantage that a large number of devices can be arranged and formed over a large area. Therefore, various applications for which the characteristic is utilized have been studied. For example, there are given an electron source plate in which a large number of surface conduction electron-emitting devices are connected by matrix wiring and an image-forming apparatus such as a display apparatus using such an electron source plate.

A structural example of the electron source plate in which a large number of surface conduction electron-emitting devices are connected by matrix wiring is shown in FIG. 14. In FIG. 14, reference numeral 21 denotes a substrate, 22 and 23 denote device electrodes, 24 denotes column wirings (lower wirings), 25 denotes an insulating layer, 26 denotes row wirings (upper wirings), and 27 denotes an electroconductive film (device film).

The above electron source plate has a structure in which the plurality of column wirings 24 are formed on the substrate 21, the plurality of row wirings 26 are formed on the column wirings 24 through the insulating layer 25, electron-emitting devices including an electrode pair (device electrodes 22 and 23) each are provided in the vicinity of each cross point of both the wirings, one of the electrode pair (device electrode 23) is connected to the column wiring 24, and the other thereof (device electrode 22) is connected to the row wiring 26 through a contact hole provided in the insulating layer 25.

SUMMARY OF THE INVENTION

When an image-forming apparatus such as a display apparatus is composed of an electron source plate in which a large number of electron-emitting devices are connected by matrix wiring as described above, the following materials are used for an increase in area and improvement of quality.

First, it is required that a thick film paste made of metal and glass frit is used as a wiring material and baked at a high temperature of about 500 ° C. in order to respond to a required wiring resistance. As the metal, silver is used in view of a specific resistance and a cost. In addition, when high definition is pressed for the improvement of quality, it is essential that the wiring material is shifted from a screen printing material to a photo paste material.

Further, noble metals capable of keeping a resistance even at a high temperature as in paste burning are suitable for a device electrode material. Above all, ruthenium is utilized because silver of the wiring material is hard to diffuse to a device portion (electroconductive film in surface conduction electron-emitting device).

Also, in view of high definition of an image, it is required that respective connection portions between the device electrodes and the column wirings are formed in regions located under the row wirings to make a pixel pitch smaller. In addition, in order to improve reliability of electrical connections between the device electrodes and the column wirings, it is required that the respective connection portions between the device electrodes and the column wirings are formed in the regions located under the row wirings to provide wider contact surfaces.

However, when a silver wiring (column wiring) made of a photo paste material is formed on ruthenium (device electrode), a bubble-shaped defect may be caused in the silver wiring. When the bubble-shaped defect is caused in the connection portion between ruthenium (device electrode) and the silver wiring which are formed in the region located under the row wiring, this becomes a cause of occurrence of a cross short between the row wiring and the column wiring which are laminated to sandwich an insulating layer on the column wiring.

Therefore, an object of the present invention is to alleviate such disadvantages of the conventional technique, and to reduce a defect resulting from an interaction with the device electrode at the time of wiring formation in the formation of an electron source plate to improve insulation reliability of a passive matrix type wiring so that a high quality image is obtained by a large size and higher density pixel arrangement in an image-forming apparatus using the electron source plate.

In order to solve the above problems, according to the present invention, the following means are provided.

Therefore, the present invention relates to an electron source plate including:

a substrate, wirings arranged in a matrix of column wirings and row wirings on the substrate, an insulating layer being interposed between column and row wirings at each cross point of column and row wirings, and electron emitting devices each of which is provided with a pair of device electrodes arranged in the vicinity of each cross point of column and row wirings, in which a covering layer covers a portion of one of the pair of device electrodes, the portion is neighboring to the cross point of column and row wirings, one of column and row wirings which is connected to the one of the pair of device electrodes overlies the covering layer and the covering layer comprises a material different from those of the one of column and row wirings and the one of the pair of device electrodes.

Further, in the above electron source plate according to the present invention, it is preferable that the device electrodes each are formed of a ruthenium film and the column wirings are formed of a sintered compact of photo paste made of silver powder and frit glass.

Further, in the above electron source plate according to the present invention, it is preferable that in the one of the pair of device electrodes which is electrically connected to the one of column and row wirings, a plurality of electron-emitting devices are formed with a common electrode along the one of column and row wirings.

Further, in the above electron source plate according to the present invention, it is preferable that the one of the pair of device electrodes is electrically connected to the one of column and row wirings through a resistor region having a higher resistance value than the pair of device electrodes.

Further, in the above electron source plate according to the present invention, it is preferable that the covering layer is an $SiO_2$ film.

Further, in the above electron source plate according to the present invention, it is preferable that the covering layer is a resistor layer having a higher resistance value than the pair of device electrodes.

Further, in the above electron source plate according to the present invention, it is preferable that the covering layer is formed in the same pattern as the insulating layer.

Further, the present invention relates to a method of fabricating an electron source plate including:

a substrate, wirings arranged in a matrix of column wirings and row wirings on the substrate, an insulating layer being interposed between column and row wirings at each cross point of column and row wirings, and electron emitting devices each of which is provided with a pair of device electrodes arranged in the vicinity of each cross point of column and row wirings, the method including:

forming the pair of device electrodes on the substrate, forming a covering layer to cover a portion of one of the pair of device electrodes, the portion being neighboring to a position which is to be the cross point of column and row wirings, forming one of column and row wirings which is to be connected to the one of the pair of device electrodes with overlying the covering layer forming the insulating layer to insulate the one of column and row wirings at an region which is to be the cross point of column and row wirings; and forming the other of column and row wirings with overlying the insulating layer at the cross point of column and row wirings, in which the covering layer comprises a material different from those of the one of column and row wrings and the one of the pair of device electrodes.

Further, in the above method of fabricating an electron source plate according to the present invention, it is preferable that the device electrodes each are formed of a ruthenium film patterned by dry etching and the column wirings are formed of a sintered compact of photo paste made of silver powder and frit glass.

Further, in the above method of fabricating an electron source plate according to the present invention, it is preferable that in the one of the pair of device electrodes which is electrically connected to the one of column and row wirings, a plurality of electron-emitting devices are formed with a common electrode along the one of column and row wirings.

Further, in the above method of fabricating an electron source plate according to the present invention, it is preferable that the one of the pair of device electrodes is electrically connected to the one of column and row wirings through a resistor region having a higher resistance value than the pair of device electrodes.

Further, in the above the method of fabricating an electron source plate according to the present invention, it is preferable that the covering layer is an $SiO_2$ film formed by a sputtering method.

Further, in the above method of fabricating an electron source plate according to the present invention, it is preferable that the covering layer is a resistor layer having a higher resistance value than the pair of device electrodes.

Further, in the above method of fabricating an electron source plate according to the present invention, it is preferable that the insulating layer is formed of photo paste made of frit glass and the covering layer is formed by a dry etching method using as a mask a resist formed using an exposure mask for the insulating layer.

Further, the present invention relate to an image-forming apparatus including the above electron source plate of the present invention and an image-forming member.

DETAILED DESCRIPTION OF THE PREFERRED EMBODIMENTS

Hereinafter, a preferred embodiment mode of the present invention will be illustratively described in detail with reference to the drawings. Note that, with respect to sizes, materials, shapes, relative arrangements, and the like of structural parts which are described in the embodiment mode, it is not meaning that the scope of the present invention is limited to only them.

Figure 13A:
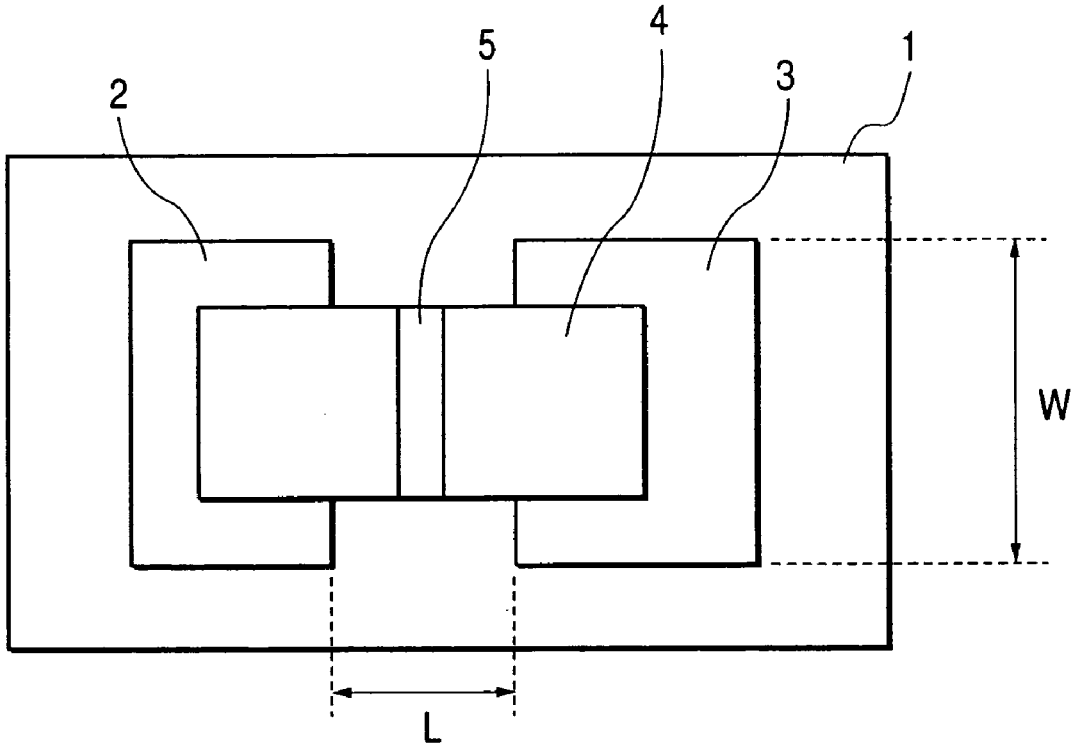
FIG. 13A is a plan view schematically showing a structural example of an electron-emitting device according to the present invention and FIG. 13B is a cross Sectional view schematically showing the structural example of the electron-emitting device according to the present invention.
Figure 13B:
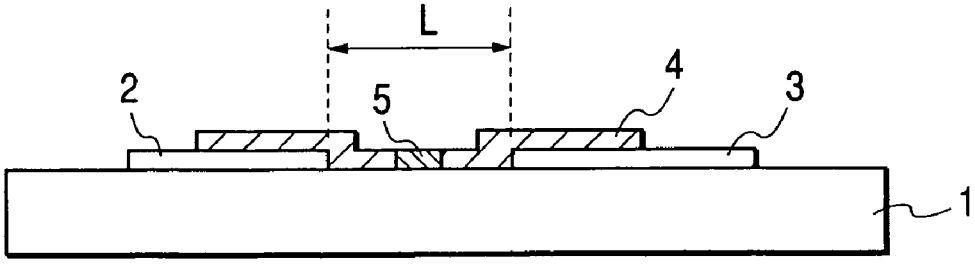
Figure 14:
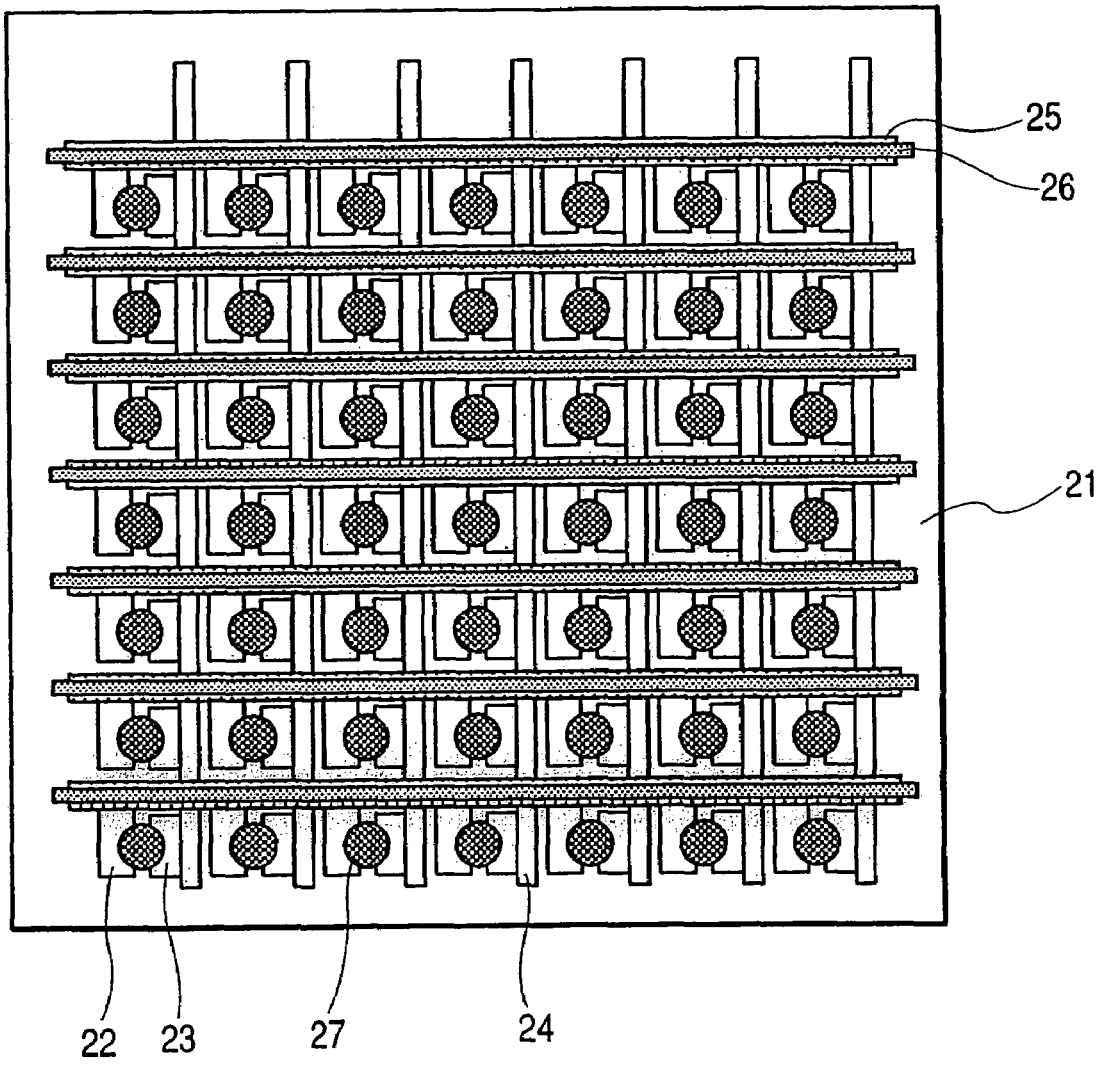
FIG. 14 is a plan view schematically showing a conventional electron source plate.

With respect to an electron-emitting device formed to an electron source plate of the present invention, there is a structure of a surface conduction electron-emitting device shown in FIGS. 13A and 13B.

With respect to a substrate 1, there are a glass substrate made of., for example, quartz glass, glass in which the amount of contained impurity such as Na is reduced, soda lime glass, or glass on which $SiO_2$ is formed on the surface thereof, a ceramics substrate made of a material such as alumina, and the like.

As a material of device electrodes 2 and 3, noble metals capable of keeping a resistance even in a high temperature as at paste burning in wiring formation which will be described later are suitable. Of them, ruthenium is more preferable because a wiring material (particularly, silver) is hard to diffuse to a device portion (device film, that is, electroconductive film 4). For a method of forming the device electrodes, a method of forming an electrode material on the substrate 1 by sputtering or the like and then patterning it by a photolithography etching technique is suitable.

A device electrode interval L, a device electrode length W, a shape of the device electrodes 2 and 3, and the like are designed as appropriate according to a configuration to which the device is applied. The interval L is preferably several thousand angstroms to 1 mm, more preferably, 1 μm to 100 μm in consideration of, for example, a voltage applied between the device electrodes. In addition, the device electrode length W is preferably within a range of several μm to several hundred μm in consideration of a resistance value of the electrodes and an electron emission characteristic.

As the electroconductive film (device film) 4, a particle film composed of particles is more preferable in order to obtain a satisfactory electron emission characteristic. In addition, its film thickness is set as appropriate in consideration of a step coverage to the device electrodes 2 and 3, a resistance value between the device electrodes, a forming operation condition described below, and the like. It is set to preferably -several angstroms to several thousand angstroms, more preferably, 10 angstroms to 500 angstroms. Its sheet resistance value is preferably $10^3$ Ω/square to $10^7$ Ω/square.

Note that the particle film described here is a film in which a plurality of particles are aggregated, and indicates a film in which its microstructure is not only a state in which respective particles are dispersed and arranged but also a state in which particles are adjacent to each other or overlapped with each other (including an island shape). A size of a particle is several angstroms to several thousand angstroms, preferably, 10 angstroms to 200 angstroms.

An electron-emitting region 5 can be formed by energization operation (forming operation) as disclosed in, for example, Japanese Patent Application Laid-open No. 2903295 (U.S. Pat. No. 6,179,678 B and U.S. Pat. No. 6,246,168 B). Note that, for convenience of showing, the electron-emitting region 5 is indicated with a rectangular shape in the central portion of the electroconductive film 4. However, this is a schematic view, and an actual position and an actual shape of the electron-emitting region are not represented faithfully.

when energization is conducted between the device electrodes 2 and 3 under a predetermined degree of vacuum, a gap (fissure) in which a structure is changed is formed in a region of the electroconductive film 4. This gap region composes the electron-emitting region 5. Note that, in the case of a predetermined voltage, electron emission is produced even in the vicinity of the gap formed by the forming. However, in this state, electron emission efficiency is still very low.

Therefore, in order to improve the electron emission efficiency, it is desirable that operation which is called activation disclosed in Japanese Patent Application Laid-open No. 2903295 (U.S. Pat. No. 6,179,678 B and U.S. Pat. No. 6,246,168 B) is conducted for the above device.

By the above steps, the electron-emitting device as shown in FIGS. 13A and 13B can be fabricated.

A fundamental characteristic of the electron-emitting device fabricated according to the above mentioned device structure and fabricating method will be described using FIG. 11.

Figure 11:
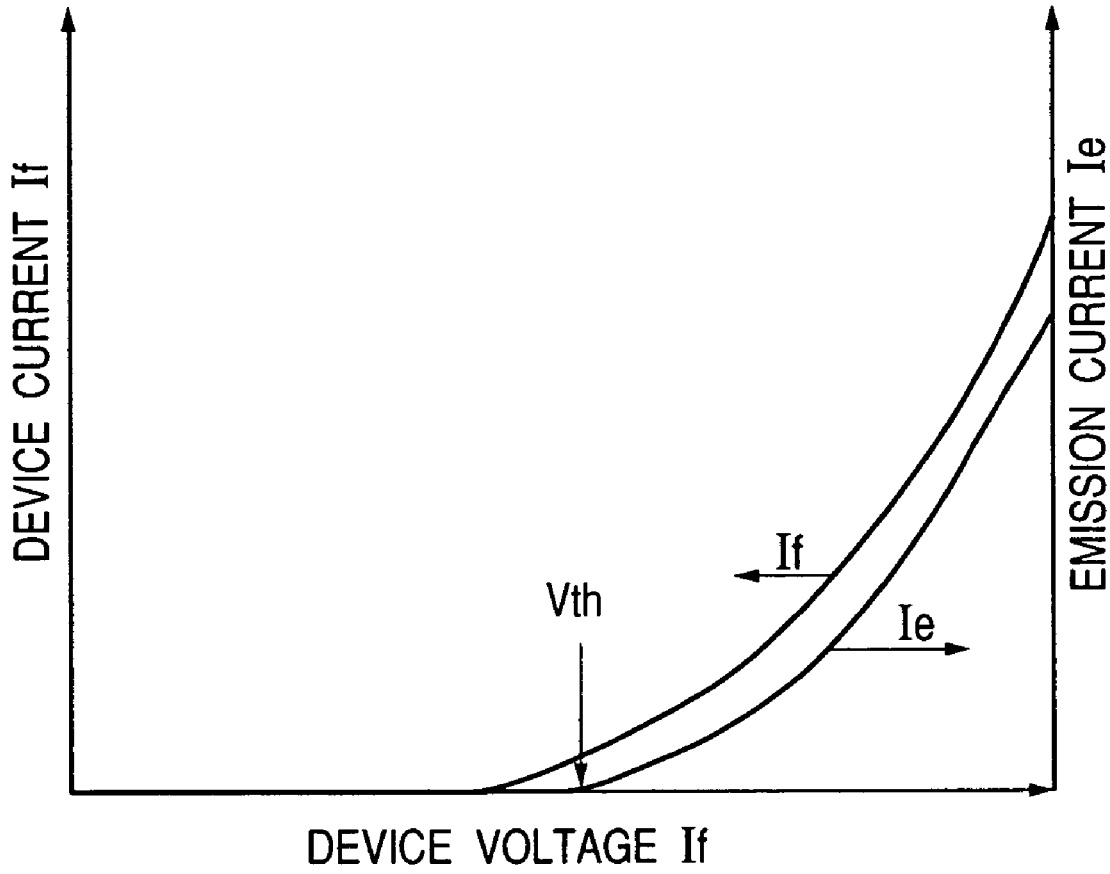
FIG. 11 shows a relationship between a device current and a device voltage and a relationship between an emission current and the device voltage in a surface conduction electron-emitting device according to the present invention.

FIG. 11 shows a typical example of relationships between an emission current Ie and a device current If and a device voltage Vf which are measured by a measurement evaluation apparatus disclosed in Japanese Patent Application Laid-open No. 2903295 (U.S. Pat. No. 6,179,678 B and U.S. Pat. No. 6,246,168 B) and the like. Note that the emission current Ie and the device current If are markedly different from each other in amplitude. However, in FIG. 11, for qualitative comparison and study with respect to changes in If and Ie, a linear scale is used and the ordinate is represented in an arbitrary unit.

The present electron-emitting device has the following three characteristics with respect to the emission current Ie.

First, as is apparent from FIG. 11, according to the device, when the device voltage equal to or larger than a voltage (called a threshold voltage, Vth in FIG. 11) is applied, the emission current Ie rapidly increases. On the other hand, when the device voltage is equal to or smaller than the threshold voltage Vth, the emission current Ie is hardly detected. In other words, it is found that the present electron-emitting device has a characteristic as a non-linear device with a specific threshold voltage Vth to the emission current Ie.

Second, the emission current Ie is dependent on the device voltage Vf so that the emission current Ie can be controlled according to the device voltage Vf.

Third, emission charges trapped in an anode electrode 54 are dependent on a time for when the device voltage Vf is applied. In other words, the amount of charges trapped in the anode electrode 54 can be controlled according to the time for when the device voltage Vf is applied.

Next, an electron source plate and an image-forming apparatus according to the present invention will be described.

Figure 1:
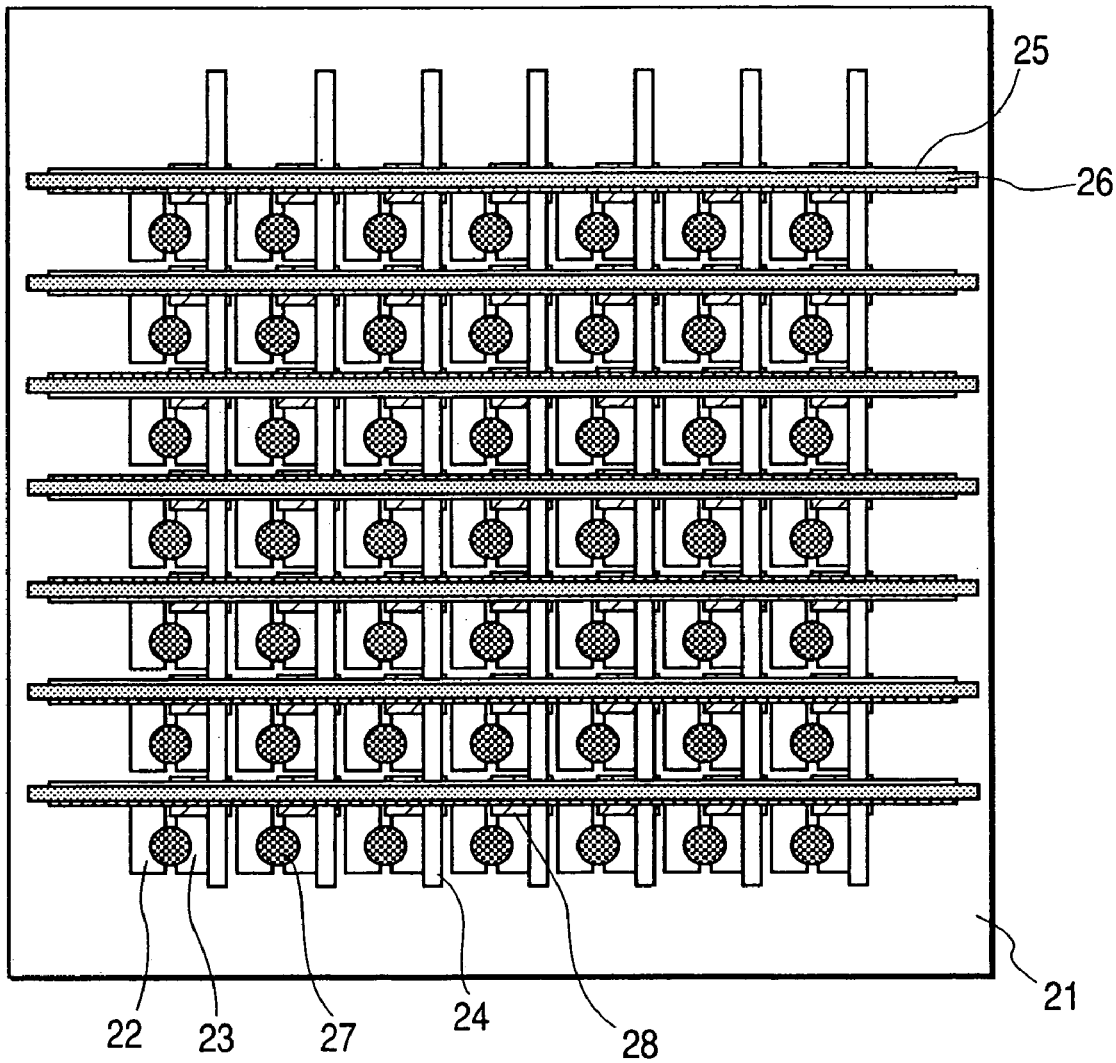
FIG. 1 is a plan view schematically showing a structural example of an electron source plate according to the present invention.
Figure 2:
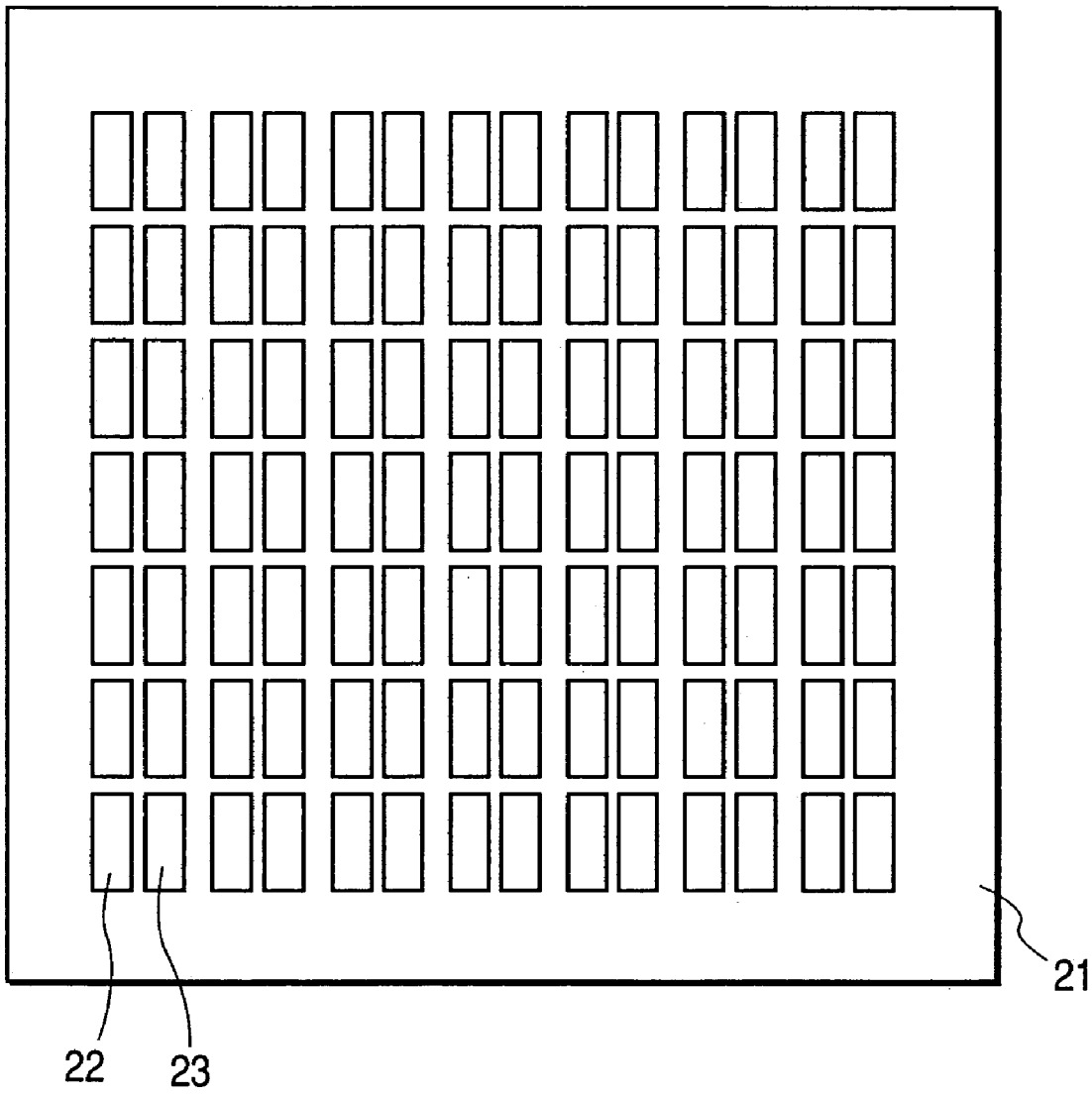
FIG. 2 is an explanatory view of a fabricating step of an electron source plate according to Embodiment 1 of the present invention.
Figure 3:
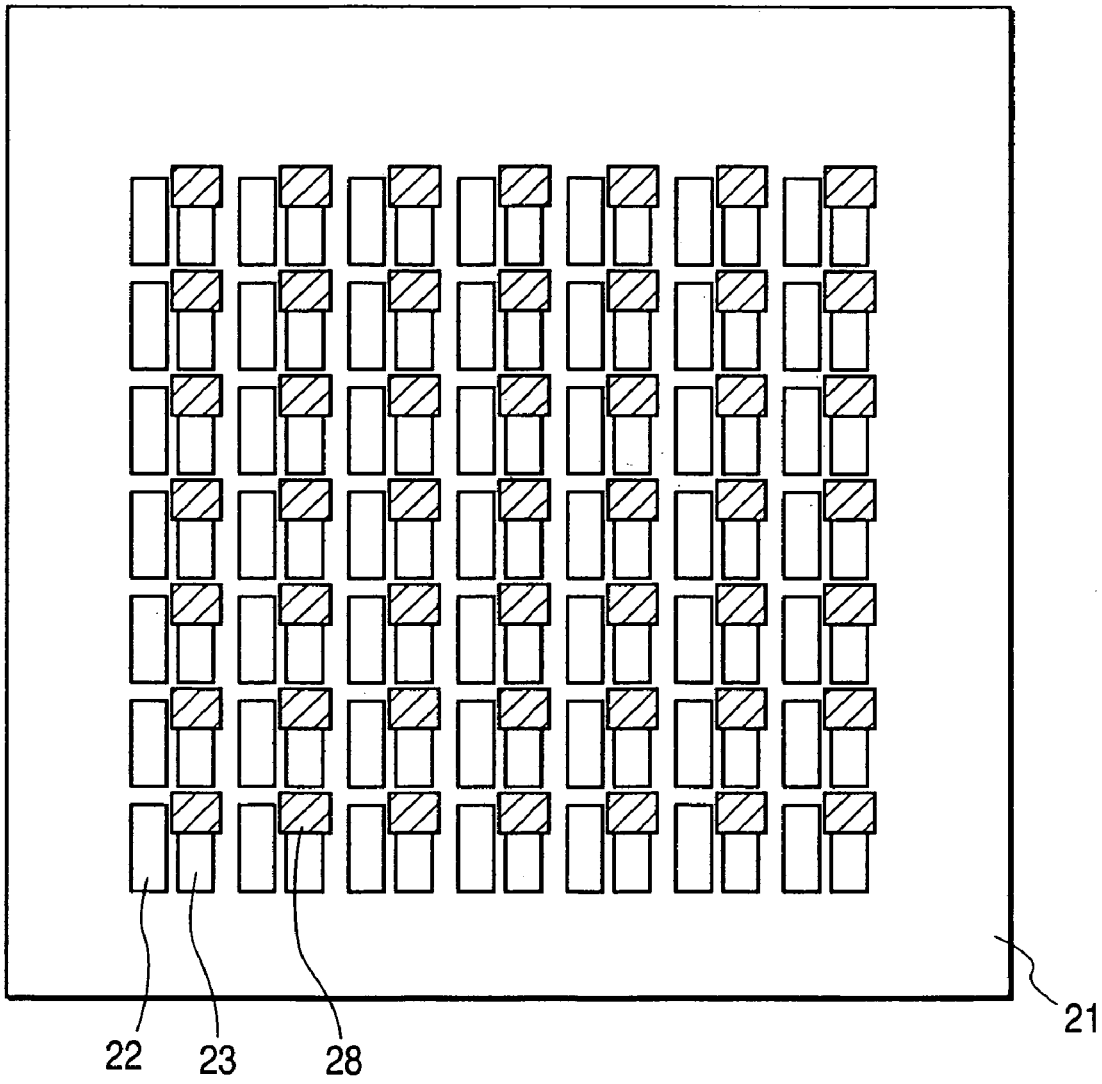
FIG. 3 is an explanatory view of a fabricating step of the electron source plate according to Embodiment 1 of the present invention.
Figure 4:
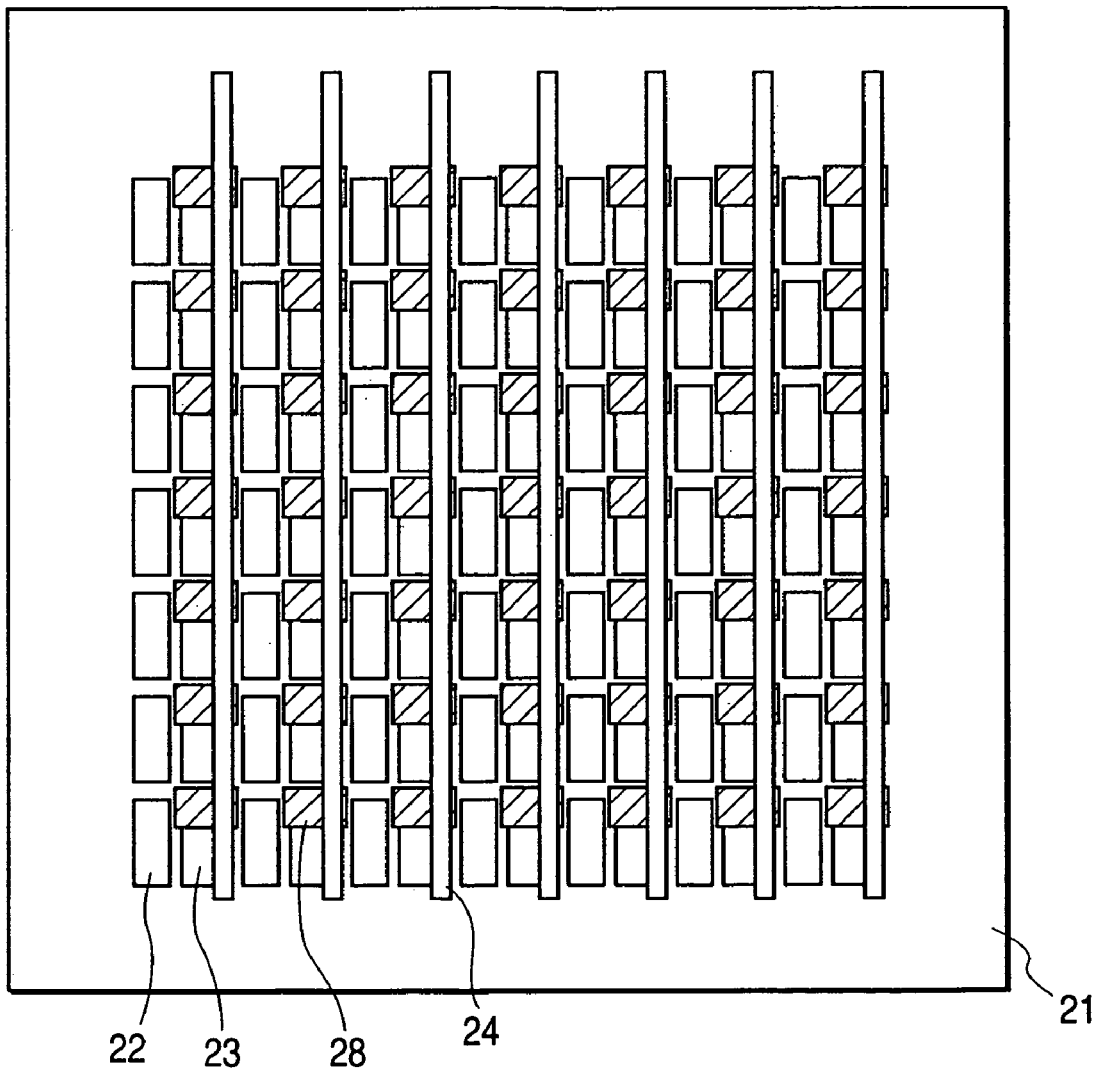
FIG. 4 is an explanatory view of a fabricating step of the electron source plate according to Embodiment 1 of the present invention.
Figure 5:
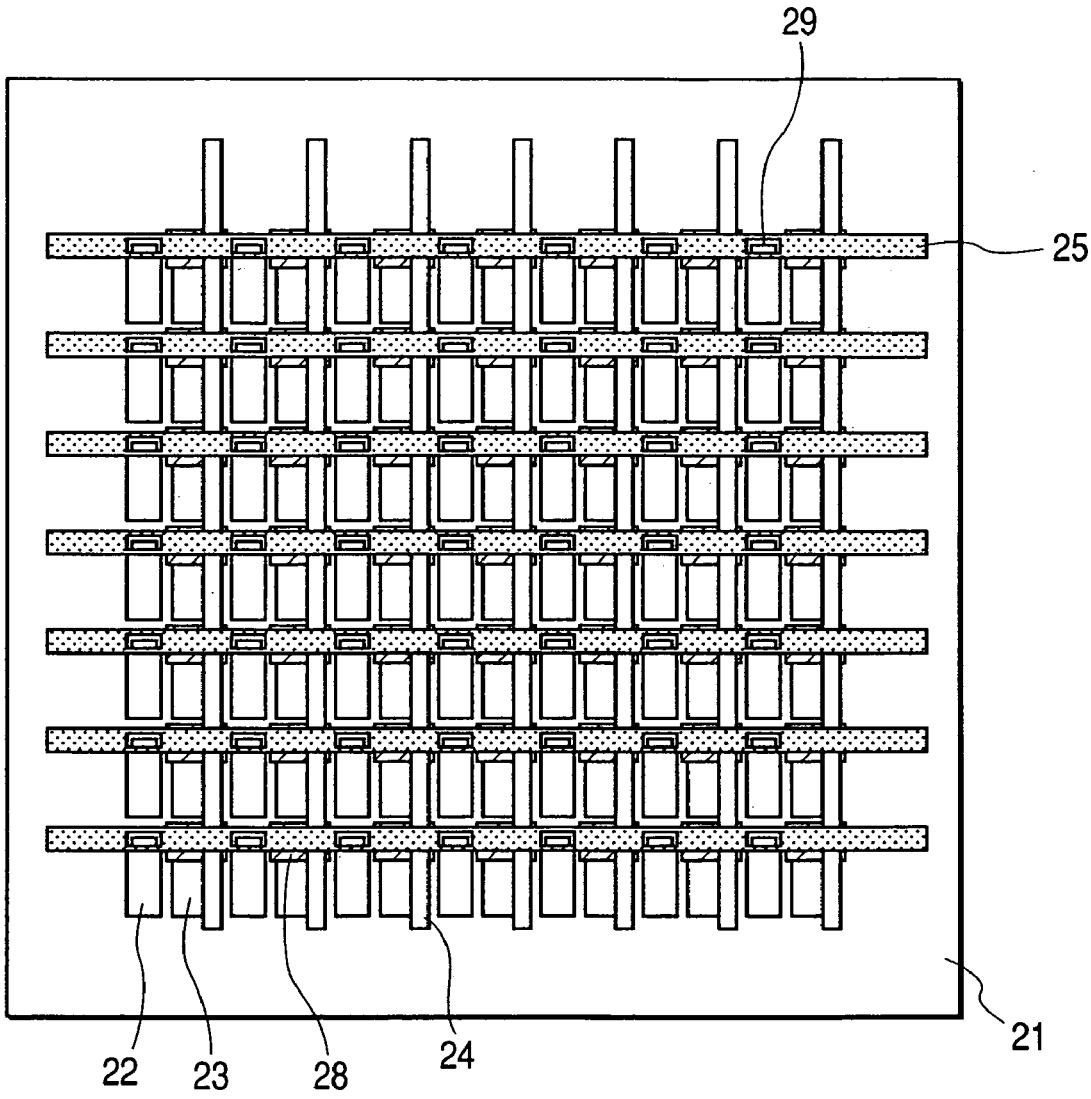
FIG. 5 is an explanatory view of a fabricating step of the electron source plate according to Embodiment 1 of the present invention.
Figure 6:
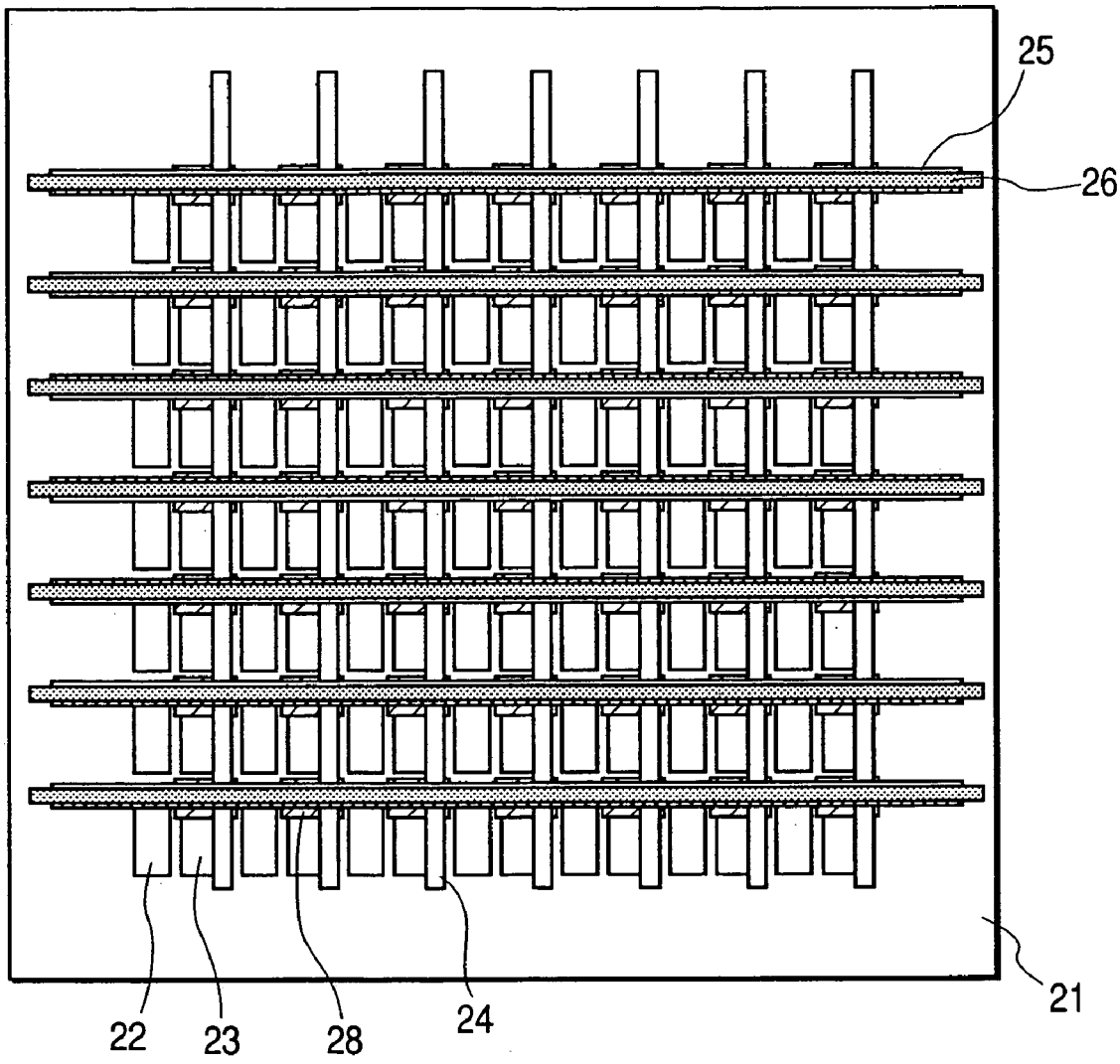
FIG. 6 is an explanatory view of a fabricating step of the electron source plate according to Embodiment 1 of the present invention.

FIG. 1 is a schematic view showing an embodiment mode of an electron source plate according to the present invention (note that FIG. 1 shows a state before forming operation). In FIG. 1, reference numeral 21 denotes a substrate, 22 and 23 denote device electrodes, 24 denotes column wirings (lower wirings), 25 denotes an insulating layer, 26 denotes row wirings (upper wirings), 27 denotes an electroconductive film, and 28 denotes a covering layer.

According to a structure of the present invention, the covering layer 28 is provided to a portion of the device electrode 23 neighboring to each cross point of the column wirings 24 and the row wirings 26, and the column wiring 24 overlies the covering layer 28 and is electrically. connected to the device electrode 23. When such a structure is used, in particular, ruthenium suitable as a device electrode material is employed, silver suitable as a wiring metallic material is employed, and the column wirings 24 are formed from a photo paste material made of silver powder and frit glass. In this case, it can be effectively prevented that a bubble-shaped defect is caused in the silver wiring (column wiring 24) in each cross point of the column wirings 24 and the row wirings 26 and in a region neighboring to each cross point. As a result, a cross short between the column wirings 24 and the row wirings 26 can be prevented.

In other words, the covering layer 28 is located in a predetermined position so that a defect resulting from an interaction with the device electrode 23 at the formation of the column wirings 24 can be reduced to improve insulation reliability of a passive matrix type wiring.

For the covering layer 28, $SiO_2$formed by, for example, a sputtering method is preferable.

Also, a pattern of the covering layer 28 is not particularly limited if an arrangement in which the above mentioned operation and effect are obtained is used. Thus, it can be also formed in the same pattern as, for example, the insulating layer 25. When the insulating layer 25 is formed from a photo paste made of frit glass, the covering layer 28 is formed by a dry etching method using as a mask a resist formed using an exposure mask for insulating layer. Therefore, the number of photo masks is reduced and reduction in cost and increase in efficiency of resources are possible.

Figure 7:
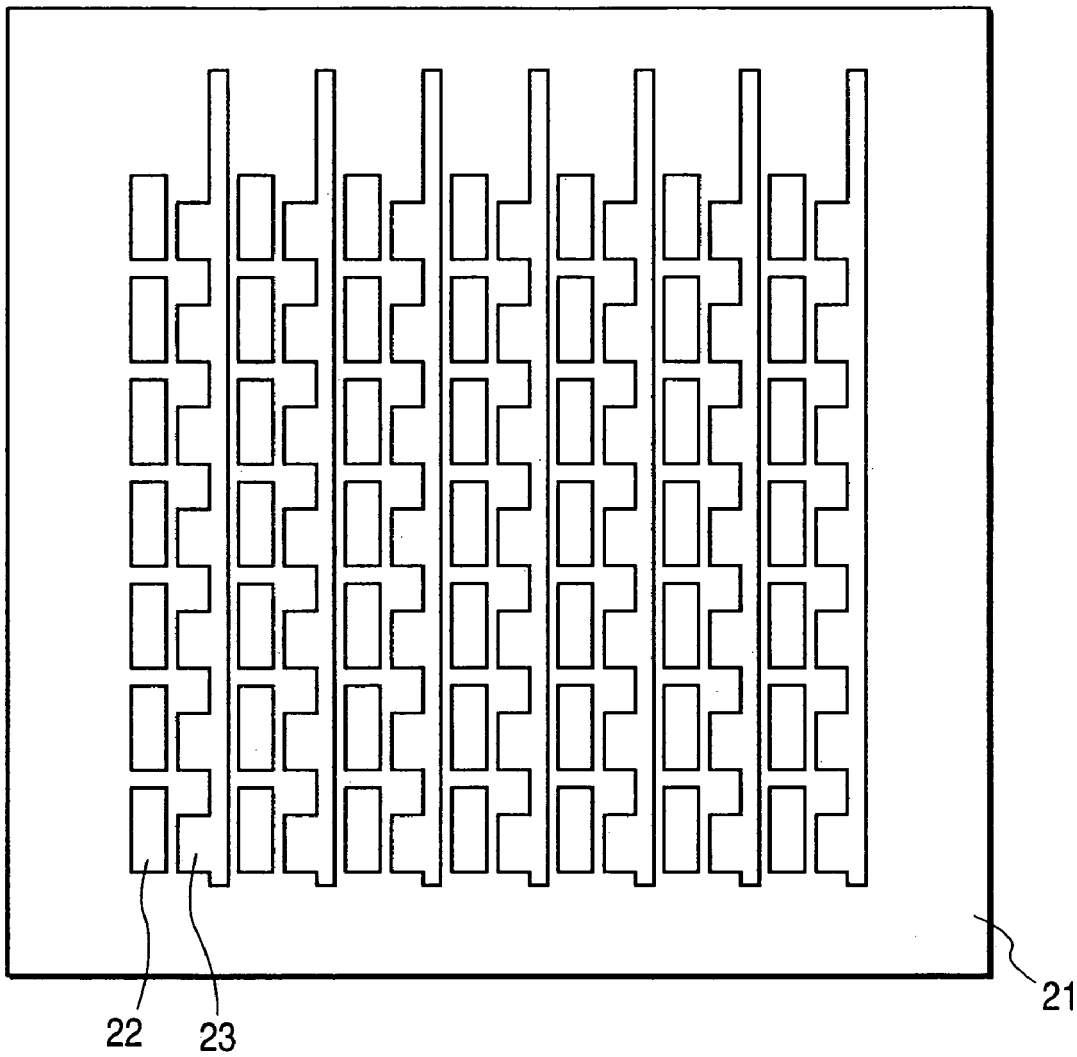
FIG. 7 is an explanatory view of a fabricating step of an electron source plate according to Embodiment 2 of the present invention.

Also, with respect to the device electrode 23 connected to the column wiring 24, it is preferable that a plurality of electron-emitting devices are formed using a common electrode along the column wiring 24. Thus, the incidence of open defects in the column wiring 24 can be greatly reduced. For example, as shown in FIG. 7, it is more preferable that all the device electrodes 23 connected to each column wiring 24 are formed in succession for each line.

An example of the image-forming apparatus using the electron source plate with the passive matrix arrangement as described above will be described using FIG. 12.

Figure 12:
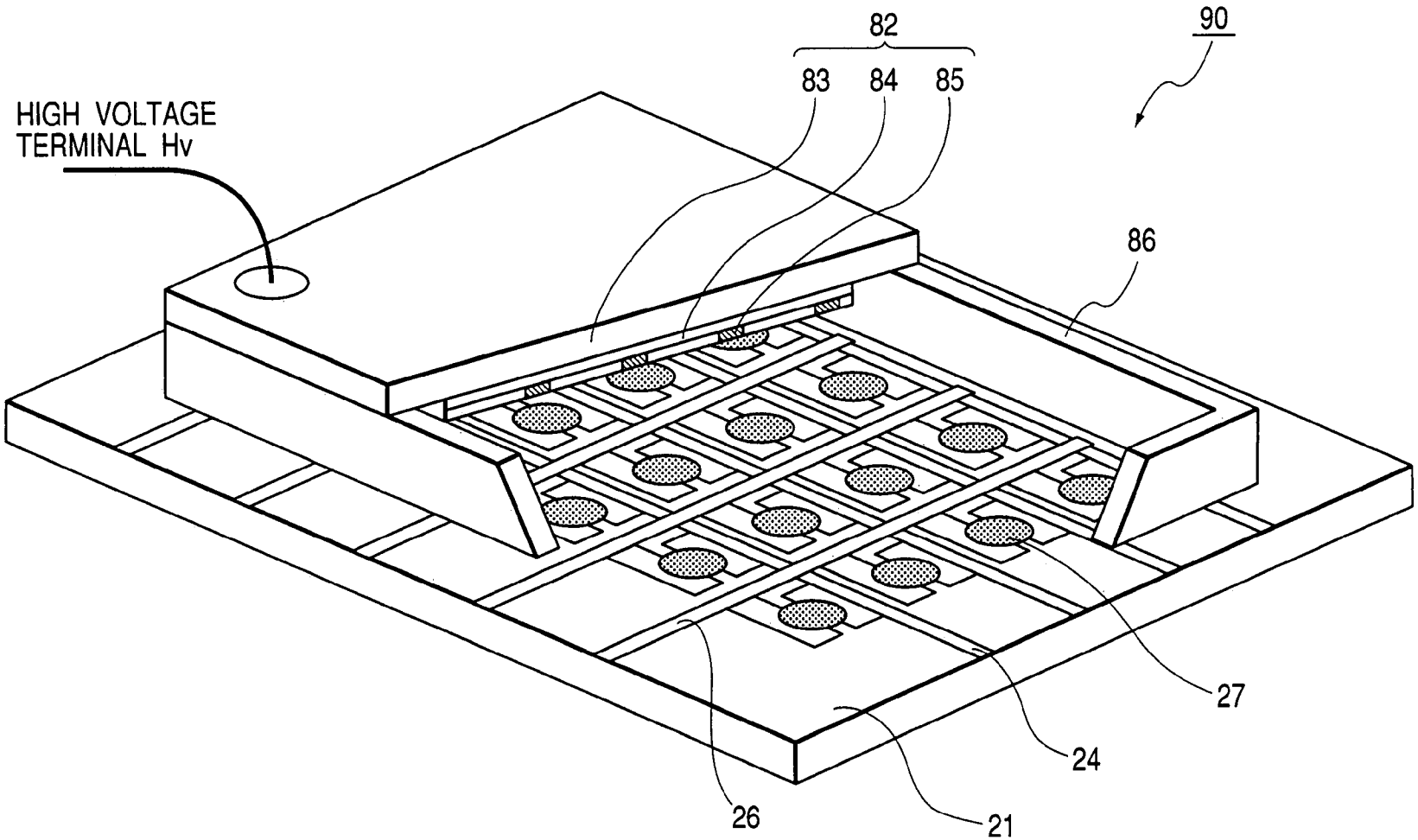
FIG. 12 is a perspective view schematically showing a structural example of an image-forming apparatus according to the present invention.

In FIG. 12, reference numeral 21 denotes the above mentioned electron source plate, 82 denotes a face plate in which a fluorescent film 84, a metal back 85, and the like are formed on the inner surface of a glass substrate 83, and 86 denotes a support frame. The electron source plate 21, the support frame 86, and the face plate 82 are bonded using frit glass and burned for seal bonding at 400° C. to 500° C. for 10 minutes or longer to construct an envelope 90.

Note that, when a supporter which is called a spacer and not shown is provided between the face plate 82 and the electron source plate 21, an envelope with a sufficient strength against an atmospheric pressure can be constructed even in the case of a large area panel.

The fluorescent film 84 provided to the face plate 82 is disclosed in Japanese Patent Application Laid-open No. 2903295 (U.S. Pat. No. 6,179,678 B and U.S. Pat. No. 6,246,168 B).

As the degree of vacuum at seal bonding, the degree of vacuum of about $10^{-5}$ Pa is required. In addition to this, in order to keep the degree of vacuum constant after seal bonding for the envelope 90, there is a case where getter operation disclosed in Japanese Patent Application Laid-open No. 2903295 (U.S. Pat. No. 6,179,678 B and U.S. Pat. No. 6,246,168 B) is conducted.

According to the fundamental characteristic of the surface conduction electron-emitting device in the present invention as described above, electrons emitted from the electron-emitting region are controlled according to a peak value and a width of a pulse voltage applied between the opposed electrodes in the case of the threshold value or higher and the amount of current is controlled even if its intermediate value is used. Thus, halftone display becomes possible.

Also, when a large number of electron-emitting devices are arranged, a selection line is determined in accordance with a scanning line signal for each line and the above mentioned pulse voltage is applied to each of the devices as appropriate through each information signal line. Thus, it becomes possible that a voltage is applied to an arbitrary device as appropriate. Therefore, each of the devices can be turned ON.

Also, with respect to a method of modulating an electron-emitting device in accordance with an input signal having a halftone, there are a voltage modulation method and a pulse width modulation method.

With respect to a specific drive device, a structural example of an image-forming apparatus for television display utilizing a display panel composed of an electron source plate with a passive matrix arrangement, which is based on a television signal of a NTSC system, is disclosed in Japanese Patent Application Laid-open No. 2903295 (U.S. Pat. No. 6,179,678 B and U.S. Pat. No. 6,246,168 B).

As described above, according to the image-forming apparatus of the present invention, a voltage is applied to each of the electron-emitting devices through both wirings to emit electrons, a high voltage is applied to the metal back 85 as an anode electrode through a high voltage terminal Hv connected to a direct current voltage source Va. Thus, a generated electron beam is accelerated and collides against the fluorescent film 84 so that an image can be displayed.

The structure of the image-forming apparatus described here is an example of an image-forming apparatus of the present invention, and therefore various modifications can be made based on a technical idea of the present invention.

Hereinafter, embodiments of the present invention will be described. Note that the present invention is not limited to these embodiments.

(Embodiment 1)

This embodiment is an example in which the electron source plate as shown in FIG. 1 in which a large number of electron-emitting devices shown in FIGS. 13A and 13B are formed on a substrate and connected by matrix wiring is fabricated.

Hereinafter, a method of fabricating an electron source plate of this embodiment will be described using FIGS. 1 to 6.

(Formation of Device Electrode: See FIG. 2)

As to a substrate 21, an $SiO_2$ film having a thickness of 100 nm is applied as a sodium block layer on glass having a thickness of 2.8 mm in which an alkali component is small (PD-200 produced by Asahi Glass Co., Ltd.) and burned so that a resultant substrate is used. First, a titanium (Ti) film (5 nm in thickness) is formed as a base layer on the glass substrate 21 by a sputtering method and a ruthenium (Ru) film (40 nm in thickness) is formed thereon by a sputtering method, and then a resist is applied thereto and patterned by a series of photolithography methods including exposure, development, and etching to form device electrodes 22 and 23. Note that, in this embodiment, a device electrode interval L is set to 10 μm and an opposite length W is set to 100 μm.

(Formation of Covering Layer: See FIG. 3)

Next, an $SiO_2$ film (100 nm in thickness) is formed by a sputtering method and patterned by photolithography methods as in the previous process, and then a covering layer 28 is formed in each cross point of column wirings 24 and row wirings 26 which are formed later and in a region neighboring to each cross point.

(Formation of Lower wirings: See FIG. 4)

The column wirings (lower wirings) 24 as common wirings are formed in a line pattern such that they are in contact with one device electrode 23 and connected to each other. For the material, a silver photo paste ink (produced by Du Pont KK, DC-206) is used and screen printing is conducted. After drying, exposure and development are conducted for obtaining a predetermined pattern. After that, burning is conducted at a temperature of about 480° C. to form the column wirings 24. A thickness of the column wirings 24 is about 10 μm and a width thereof is about 50 μm. Note that terminal portions which are not shown are used as wiring lead electrodes so that a line width is made larger.

(Formation of Insulating Layer: See FIG. 5)

In order to insulate between upper and lower wirings, an insulating layer 25 is formed. It is located under row wirings (upper wirings) as described later and covers cross points with the previous formed column wirings (lower wirings) 24. A contact hole 29 is opened and formed in a connection portion corresponding to each of the devices such that electrical connection between the row wirings (upper wirings) and the device electrode 2 is possible.

Specifically, screen printing is conducted using a photosensitive glass paste containing mainly PbO and then exposure and development are conducted. Such operation is repeated four times, and finally burning is conducted at a temperature of about 480° C. A thickness of the insulating layer 25 is about 30 μm in total and a width thereof is 150 μm.

(Formation of Upper Wiring: See FIG. 6)

Screen printing using an Ag paste ink is conducted on the previous formed insulating layer 25 and then it is dried, and the same operation is conducted again thereon for two-times application. After that, burning is conducted at a temperature of about 480° C. to form the row wirings (upper wirings) 26. The row wirings 26 cross the column wirings 24 through the insulating layer 25 interposed therebetween and are connected to the device electrode 22 through the contact hole 29 provided in the insulating layer 25.

The row wirings 26 function as scanning electrodes at electrical drive. Note that a thickness of the row wirings 26 is about 15 μm. Although not shown, lead terminals to an external driver circuit are also formed by the same method.

Accordingly, the substrate having X-Y matrix wirings is formed.

Next, the above mentioned substrate is sufficiently cleaned, and then the surface thereof is processed using a solution containing a water repellent agent such that the surface becomes hydrophobic. This is because an aqueous solution for electroconductive film formation which is applied after that is located with moderate expansion on the device electrode.

(Formation of Electroconductive Film: See FIG. 1)

Next, an electroconductive film 27 is formed between the device electrodes 22 and 23. In this step, the method disclosed in Japanese Patent Application Laid-open No. 09-102271 (U.S. Pat. No. 6,296,896 B) is used. Note that, in order to compensate a two-dimensionally variation in respective device electrodes on the substrate 21, an arrangement shift in pattern is observed in several locations on the substrate, the amount of shift of point among observing points is corrected using a linear approximation to interpolate a position, and an electroconductive film forming material is applied. Thus, a shift in positions of all pixels is prevented so that the material is accurately applied to a corresponding location.

In this embodiment, in order to obtain a palladium film as the electroconductive film, first, a palladium-proline complex with 0.15 weight % is dissolved in an aqueous solution containing water and isopropyl alcohol. (IPA) at 85:15 to obtain an organic palladium containing solution. In addition to this, an additive is slightly added. An inkjet injection device using a piezoelement is used as drop applying means, a dot size is adjusted to 60 μm, and a drop of the solution is applied between the device electrodes.

After that, heat and burning treatment for the substrate is conducted at 350° C. for 10 minutes in an air to form an electroconductive film made of palladium oxide (PdO).

(Forming Step)

Next, in this step which is called forming, energization operation is conducted for the above mentioned electroconductive film to cause a fissure in an inner portion thereof so that an electron-emitting region 5 is produced.

Note that the specific method is disclosed in Japanese Patent Application Laid-open No. 2903295 (U.S. Pat. No. 6,179,678 B and U.S. Pat. No. 6,246,168 B).

In the forming operation, the voltage wave form disclosed in Japanese Patent Application Laid-open No. 2903295 (U.S. Pat. No. 6,179,678 B and U.S. Pat. No. 6,246,168 B) is used.

(Activation Step)

After the above-described forming step, an activation step is conducted by the method disclosed in Japanese Patent Application Laid-open No. 2903295 (U.S. Pat. No. 6,179,678 B and U.S. Pat. No. 6,246,168 B).

By the above-described step, the electron source plate in which a large number of electron-emitting devices are connected by matrix wiring on the substrate can be fabricated.

In the electron source plate of this embodiment, the emission current Ie is measured in the case where a voltage of 12 V is applied between the device electrodes in each of the devices. As a result, an average current is 0.6 μA and electron emission efficiency of 0.15% in average is obtained. In addition, uniformity among devices is good, and a preferable value is obtained such that a variation in Ie among the respective devices is 5%.

Next, the image-forming apparatus (display panel) as shown in FIG. 12 is fabricated using the electron source plate with the passive matrix arrangement which is produced as described above. Note that, in FIG. 12, the apparatus is partially cut to show an inner portion thereof.

In FIG. 12, an electron source plate 21, a support frame 86, and a face plate 82 are bonded using frit glass and burned for seal bonding at 480° C. for 30 minutes to obtain an envelope 90.

In this way, the display panel as shown in FIG. 12 is produced and connected to a driver circuit which is disclosed in Japanese Patent Application Laid-open No. 2903295 (U.S. Pat. No. 6,179,678 A and U.S. Pat. No. 6,246,168 A) and composed of a scanning circuit, a control circuit, a modulation circuit, a direct current voltage source, and the like to fabricate a panel image-forming apparatus.

A predetermined voltage is applied in time division to each of the electron-emitting devices through row direction terminals and column direction terminals and a high voltage is applied to a metal back 85 through a high voltage terminal Hv. Thus, an arbitrary matrix image pattern can be displayed with a preferable image quality in which a pixel defect does not exist.

(Embodiment 2)

A shape and the like of device electrodes 22 and 23 are designed as appropriate according to a configuration and the like to which the device is applied. In this embodiment, the device electrodes 23 connected to column wirings 24 are formed in succession for each line as shown in FIG. 7. Except for this, the electron source plate as shown in FIG. 1 is fabricated as in Embodiment 1. Thus, an electron source plate in which an open defect does not exist in the column wirings 24 can be fabricated stably.

Also, the image-forming apparatus (display panel) as shown in FIG. 12 is fabricated using the electron source plate. As a result, even in the image-forming apparatus of this embodiment, an arbitrary matrix image pattern can be displayed with a satisfactory image quality in which a pixel defect does not exist.

(Embodiment 3)

Figure 8:
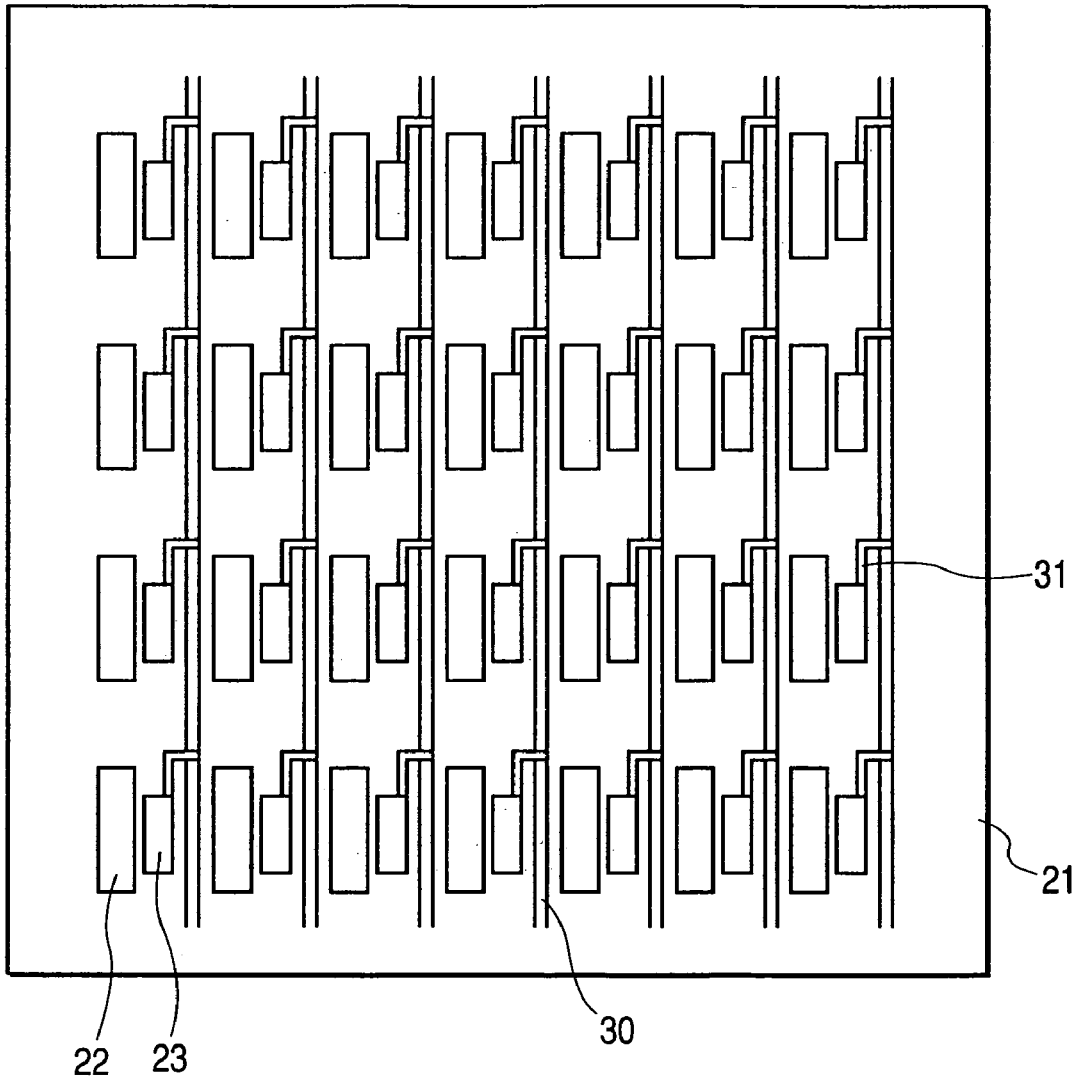
FIG. 8 is an explanatory view of a structure of an electron source plate according to Embodiment 3 of the present invention.
Figure 9:
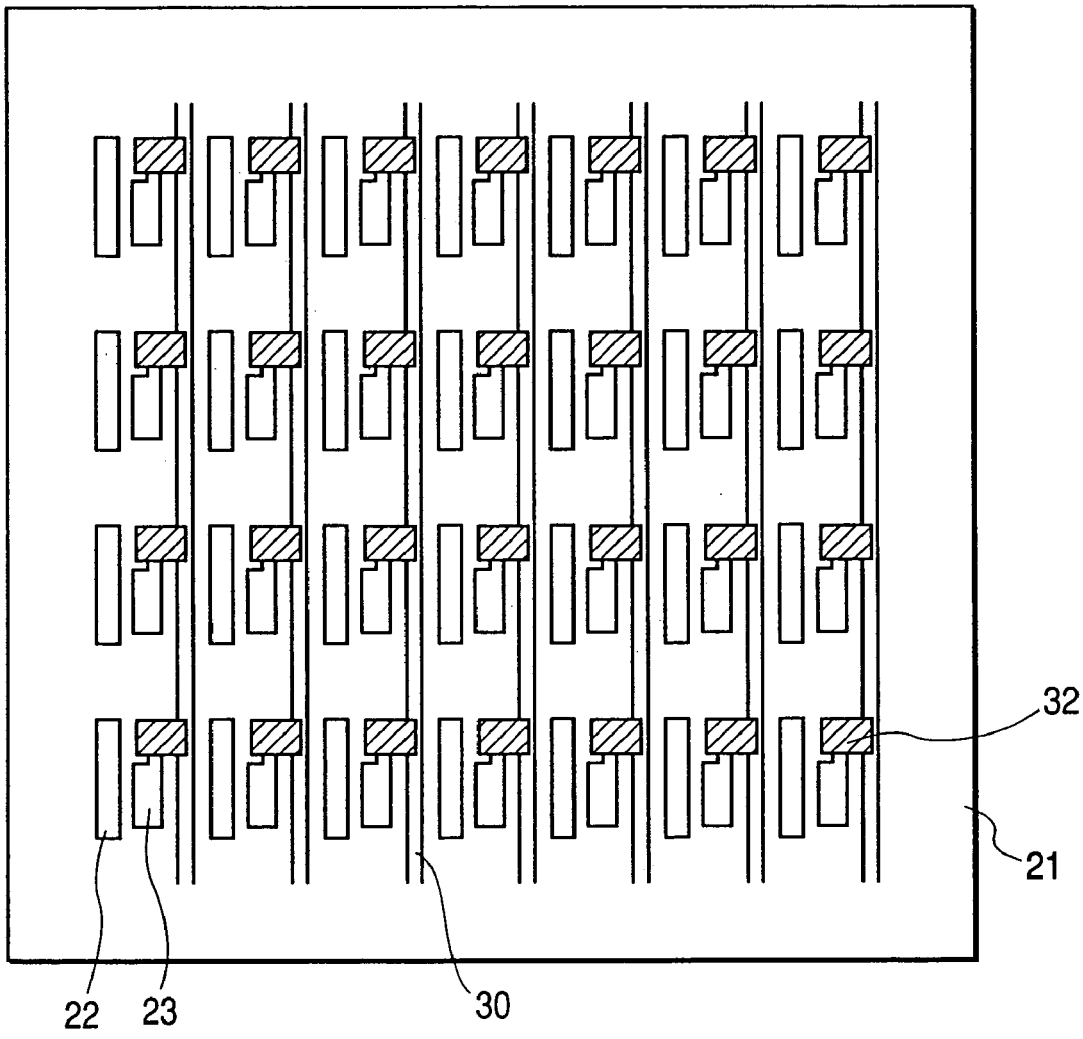
FIG. 9 is an explanatory view of a structure of an electron source plate according to Embodiment 4 of the present invention.

In this embodiment, as shown in FIG. 8, device electrodes 23 each have a resistor device region 31. The device electrode 23 is formed so as to be connected to column wirings 24 through the resistor device region 31. Except for this, the electron source plate as shown in FIG. 1 is fabricated as in Embodiment 2. In addition, it is preferable that the resistor device region 31 is formed by the same step as a device electrode forming step of forming a ruthenium (Ru) film (made of device electrode material) and then applying a resist thereto and patterning it by a series of photolithography methods including exposure, development, and etching to form device electrodes 22 and 23. Thus, with respect to an overcurrent generated by discharge of the electron-emitting device, a current flowing into the column wiring 24 can be limited because of the presence of the resistor device region 31 provided between the column wiring 24 and the device electrode 23. Therefore, a break of a drive IC connected to the column wiring and the row wiring in which the amount of allowable (supplying) current is small can be suppressed. In addition, a resistance of each of the devices becomes larger as compared with the wiring so that a discharge current (ratio) flowing into an adjacent device connected through the wiring can be reduced and a break of the adjacent device can be prevented. Here, it is preferable that the resistor device region 31 having a higher resistance value than that of the device electrode 23, for example, a value of 50 Ω to 500 kΩ, preferably, 500 Ω to 5 kΩ is used.

Also, in this embodiment, it is preferable that a base wiring 30 of the column wiring is formed by the same step as in formation of the titanium (Ti) film as a base layer of the device electrode. Thus, the reliability of electrical connection between the device electrode and the column wiring 24 can be improved. This is not limited to this embodiment and it is apparent that the same effect is provided for the present invention.

Also, the image-forming apparatus (display panel) as shown in FIG. 12 is fabricated using the electron source plate. As a result, even in the image-forming apparatus of this embodiment, an arbitrary matrix image pattern can be displayed with a satisfactory image quality in which a pixel defect does not exist.

(Embodiment 4)

A covering layer 28 is not particularly limited if an arrangement pattern and a material with which the above mentioned operation and effect are obtained are used. In this embodiment, the covering layer 28 is composed of a covering layer (resistor layer) 32 made of a resistance material. The covering layer (resistor layer) 32 made of the resistance material which is described here has a higher resistance value than that of the device electrode 23 and formed as follows. That is, for example, a photosensitive photo paste for high resistance (produced by Du Pont KK, trade name: DC243) is printed, dried at 90° C. for 10 minutes in an IR dry furnace, and patterned by a series of photolithography methods including exposure using a high pressure mercury lamp with 3 kW at 2000 mJ (365 nm) and shower development with a 0.4% sodium carbonate solution. After that, burning is conducted at a temperature of about 520° C. to form the covering layer. In addition, it is preferable that Pt cermet which is a mixture of Pt and Si, V, Bi, Zr, or the like is used for the covering layer (resistor layer) 32. In addition, it is preferable that the covering layer (resistor layer) 32 having a resistance value range of, preferably, 50 Ω to 500 kΩ, more preferably, 500 Ω to 5 kΩ is used. Except for this, the electron source plate as shown in FIG. 1 is fabricated as in Embodiment 2 or 3. Thus, as in Embodiment 3, with respect to an overcurrent generated by discharge of the electron-emitting device, a current flowing into the column wiring 24 can be limited because of the presence of the resistor device region 31 provided between the column wiring 24 and the device electrode 23. Therefore, a break of a drive IC connected to the column wiring and the row wiring in which the amount of allowable (supplying) current is small can be suppressed. In addition, a resistance of each of the devices becomes larger as compared with the wiring so that a discharge current (ratio) flowing into an adjacent device connected through the wiring can be reduced and a break of the adjacent device can be prevented.

Also, in this embodiment, it is preferable that a base wiring 30 of the column wiring is formed by the same step as in formation of the titanium (Ti) film as a base layer of the device electrode. Thus, the reliability of electrical connection between the device electrode and the column wiring 24 can be improved. This is not limited to this embodiment and it is apparent that the same effect is provided for the present invention.

Also, the image-forming apparatus (display panel) as shown in FIG. 12 is fabricated using the electron source plate. As a result, even in the image-forming apparatus of this embodiment, an arbitrary matrix image pattern can be displayed with a preferable image quality in which a pixel defect does not exist.

(Embodiment 5)

Figure 10:
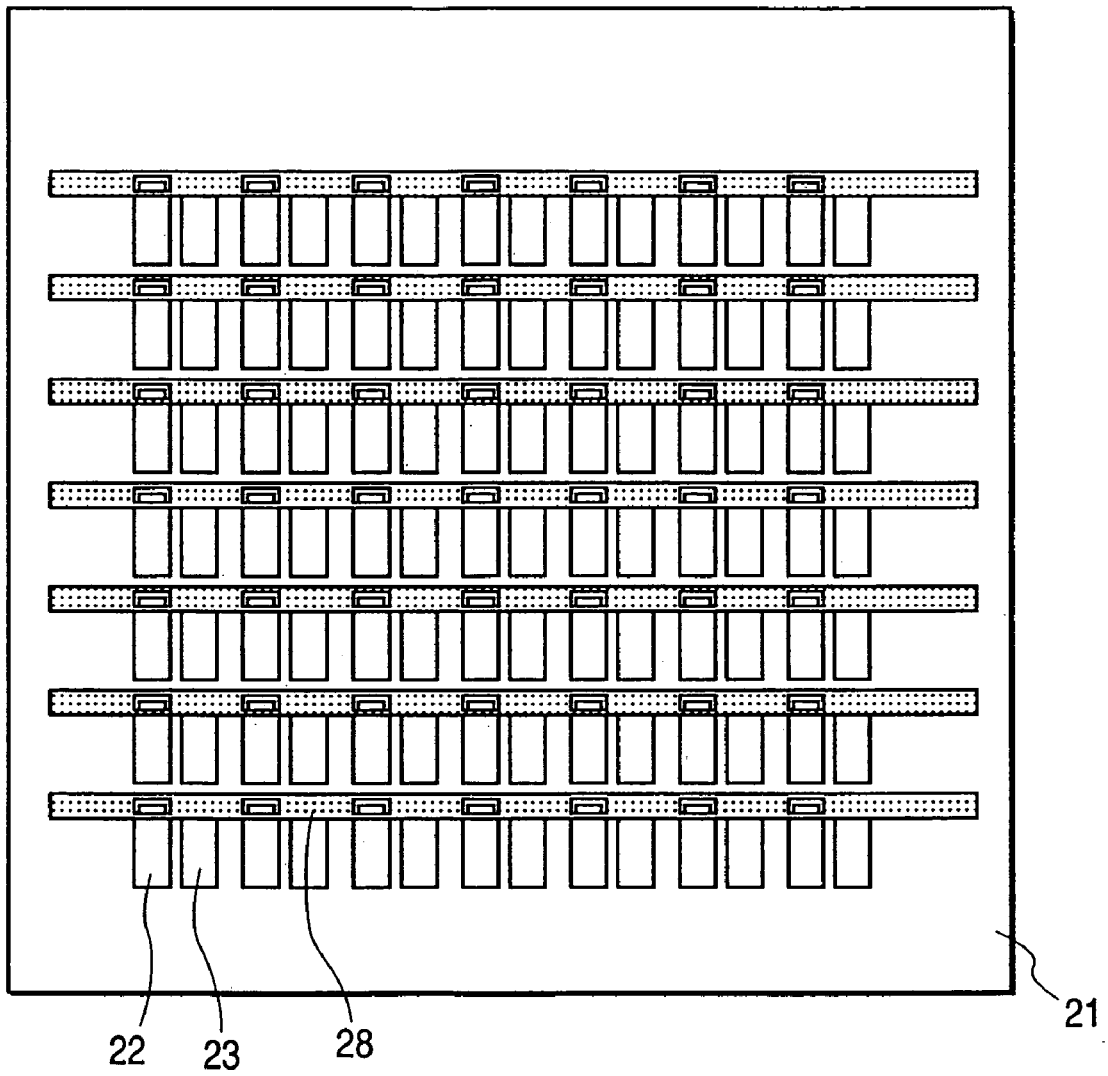
FIG. 10 is an explanatory view of a fabricating step of an electron source plate according to Embodiment 5 of the present invention.

In this embodiment, a covering layer 28 is formed by a dry etching method using as a mask a resist formed using an exposure mask for an insulating layer and formed in the same pattern as an insulating layer 25 as shown in FIG. 10. Except for this, the electron source plate as shown in FIG. 1 is fabricated as in Embodiments 2 to 4. Therefore, the number of photo masks can be reduced and a reduction in cost and increase in efficiency of resources can be realized.

The image-forming apparatus (displaypanel) as shown in FIG. 12 is fabricated using the electron source plate. As a result, even in the image-forming apparatus of this embodiment, an arbitrary matrix image pattern can be displayed with a satisfactory image quality in which a pixel defect does not exist.

According to the present invention, when fabricating an electron source plate with passive matrix arrangement, a covering layer for device electrodes is formed in advance in a region including each cross point of the column wirings (lower wirings) and row wirings (upper wirings) and under the column wirings. Thus, a defect resulting from an interaction with device electrode at wiring formation is reduced to improve insulation reliability of passive matrix wirings. Therefore, a high quality image is obtained with higher density pixel arrangement in an image-forming apparatus using the electron source plate.

What is claimed is:

1. An electron source plate comprising:

a substrate;

wirings arranged in a matrix of column wirings and row wirings on the substrate;

an insulating layer being interposed between column and row wirings at each cross point of column and row wirings;

and electron emitting devices each of which is provided with a pair of device electrodes arranged in a vicinity of each cross point of column and row wirings;

wherein a covering layer covers a portion of one of the pair of device electrodes, said portion is under the cross point of column and row wirings, and wherein one of column and row wirings which is electrically connected to said one of the pair of device electrodes is disposed over said covering layer at the cross point and said covering layer comprises a material different from those of said one of column and row wirings and said one of the pair of device electrodes.

2. An electron source plate according to claim 1, wherein said one of the pair of device electrodes is electrically connected to said one of column and row wirings through a resistor region having a higher resistance value than the pair of device electrodes.

* * * * *